US007592754B2

(12) United States Patent
Schindler

(10) Patent No.: US 7,592,754 B2
(45) Date of Patent: Sep. 22, 2009

(54) METHOD AND APPARATUS FOR DRIVING A LIGHT EMITTING DIODE

(75) Inventor: Frederick Roland Schindler, Sunnyvale, CA (US)

(73) Assignee: Cisco Technology, Inc., San Jose, CA (US)

( * ) Notice: Subject to any disclaimer, the term of this patent is extended or adjusted under 35 U.S.C. 154(b) by 407 days.

(21) Appl. No.: 11/376,081

(22) Filed: Mar. 15, 2006

(65) Prior Publication Data

US 2007/0216317 A1 Sep. 20, 2007

(51) Int. Cl.
*G05F 37/02* (2006.01)
*F21V 23/04* (2006.01)
*F21V 7/04* (2006.01)

(52) U.S. Cl. ..... 315/291; 362/276; 362/555

(58) Field of Classification Search ..... 315/291, 315/299, 300, 302; 362/555, 227, 276, 800
See application file for complete search history.

(56) References Cited

U.S. PATENT DOCUMENTS

| | | | | |
|---|---|---|---|---|
| 5,121,146 | A | 6/1992 | Smith et al. | 347/238 |
| 5,467,036 | A * | 11/1995 | Sawada | 327/108 |
| 5,723,950 | A | 3/1998 | Wei et al. | 315/169.3 |
| 6,597,123 | B1 * | 7/2003 | Buell et al. | 315/169.3 |
| 6,667,580 | B2 * | 12/2003 | Kim et al. | 315/169.3 |
| 6,690,146 | B2 | 2/2004 | Burgyan et al. | |
| 6,724,376 | B2 * | 4/2004 | Sakura et al. | 345/204 |
| 6,741,042 | B1 * | 5/2004 | Tang | 315/291 |
| 7,004,598 | B2 * | 2/2006 | Wong | 362/103 |
| 7,400,310 | B2 * | 7/2008 | LeMay | 345/82 |
| 2002/0135572 | A1 | 9/2002 | Weindorf | |
| 2004/0001040 | A1 | 1/2004 | Kardach et al. | |
| 2005/0134191 | A1 | 6/2005 | Wong et al. | |

OTHER PUBLICATIONS

Marktech Optoelectronics, "Engineering Services Driver Application Notes," http://www.marktechopto.com/engineering/toshiba.cfm, accessed Feb. 27, 2006.

International Search Report, International Application No. PCT/US07/63944, filed on Mar. 14, 2007, 2 pages.

* cited by examiner

*Primary Examiner*—Douglas W Owens
*Assistant Examiner*—Minh D A
(74) *Attorney, Agent, or Firm*—BainwoodHuang

(57) ABSTRACT

An LED drive circuit includes a current source configured to electrically drive an LED. In one configuration, the current source forms part of an integrated circuit that requires a relatively small amount of voltage for operation. As such, separate voltage sources can be electrically coupled to the LED and integrated circuit respectively. For example, a first voltage source provides a source voltage to the LED that is sufficient to allow operation the LED and a second voltage source provides a source voltage to the integrated circuit that is sufficient to allow operation of the integrated circuit but that is less than a voltage operable to activate the LED. As a result, a low voltage source can be used as a supply for all of the circuitry associated with the integrated circuit, including the current source, without sacrificing the supply voltage used to drive the LED.

23 Claims, 7 Drawing Sheets

LED Off

LED Off

METHOD AND APPARATUS FOR DRIVING A LIGHT EMITTING DIODE

BACKGROUND

Electronic devices often employ light emitting diodes (LEDs) to indicate the activity or inactivity of the devices. In order to operate within specified parameters, LEDs typically require a relatively narrow range of direct current and voltage. As a result, to use an LED as status indicator, it is customary practice to employ a series, current-limiting resistor to adjust the voltage provided to the LED which, in turn, controls the current through, and the brightness of, the LED for a given application.

In certain devices, such as in data communications devices, a general purpose voltage source can be used to drive an LED. For example, as illustrated in the schematic of Prior Art FIG. 1, a device 10 includes an integrated circuit (IC) (e.g., physical layer (PHY)) 12, having a driver 13 and power supply pins 14, 16 where the power supply pin 14 couples to a positive supply rail 18 and the power supply pin 16 couples to a negative supply rail 20 (e.g., ground). The device 10 also includes an LED 22, and a current limiting resistor 24 coupled between the supply rail 18 and IC 12. In use, the driver 13 causes the output voltage $V_{OUT}$ to equal to the supply voltage $V_{DD}$ (e.g., the driver 13 pulls the supply voltage $V_{OUT}$ to $V_{DD}$) thereby causing a current to flow through, and activate, the LED 22. The amount of current that flows through the LED 14 is related to the supply voltage ($V_{DD}$), the output voltage ($V_{OUT}$), the LED voltage drop ($V_{LED}$) and the resistor value (R) and is governed by the equation:

$$I_{LED}=(V_{DD}-V_{OUT}-V_{LED})/R.$$

The brightness of (e.g., the amount of light emitted by) the LED 22 is proportional to the amount of current running through the LED 22.

When the supply voltage $V_{DD}$ is relatively large, the current that flows through the LED 22 is substantially constant. For example, in the case where the supply voltage $V_{DD}$ is 5V, the current that passes through the LED 22 can be between about 11 mA and 9 mA, resulting in a current tolerance between +/−11%. As a result, the brightness of the LED 22 is substantially constant over time.

SUMMARY

Developments in IC technology have reduced the amount of supply voltage $V_{DD}$ required by certain IC's. For example, certain IC's require supply voltages $V_{DD}$ of between 2.5V and 3.3V. However, as the supply voltages in certain devices are reduced to accommodate these IC's, such a reduction can affect the tolerances of the current running through an LED. For example, in the case where the supply voltage $V_{DD}$ is 3.3V, the current that passes through the LED can be between about 12 mA and 8 mA, resulting in a current tolerance between +/−17%. In the case where the where the supply voltage $V_{DD}$ is 2.5V, the current that passes through the LED can be between about 14 mA and 7 mA, resulting in a current tolerance between +/−33%. In either case, the reduced supply voltage $V_{DD}$ provides relatively large current variation within the LED thereby causing the LED to generate a variable amount of brightness.

Certain devices, such as data communications devices (e.g., a router or Power-over-Ethernet (PoE) device), include a number of status LEDs disposed in relatively close physical proximity with each other. When a reduced amount of supply voltage $V_{DD}$ is used to power the aforementioned ICs and LEDs of these devices, each of the LEDs can be driven to different levels of brightness because of the rather large current tolerances of the current. With such variable brightness, a user can visually detect the difference in brightness levels in adjacent LEDs and may believe the device to be defective. As a result, the user may return the properly functioning device to the manufacturer for "repair" or replacement.

By contrast to conventional LED driving mechanisms, embodiments of the invention are directed to a method and apparatus for driving a light emitting diode. An LED drive circuit includes a current source configured to electrically drive an LED where the current source maintains a current when the voltage across it changes. The current source draws a substantially constant current through the LED, compared to the sole use of a current liming resistor in series with the LED. In one configuration, the current source forms part of an integrated circuit that requires a relatively small amount of voltage for operation. As such, separate voltage sources can be electrically coupled to the LED and integrated circuit respectively. For example, a first voltage source provides a source voltage to the LED that is sufficient to allow operation the LED and a second voltage source provides a source voltage to the integrated circuit that is sufficient to allow operation of the integrated circuit but that is less than a voltage operable to activate the LED. As a result, a low voltage source can be used as a supply for all of the circuitry associated with the integrated circuit, including the current source, without sacrificing the supply voltage used to drive the LED. As such, the supply voltage to the LED can be large enough to minimize effects of current tolerance on the brightness of the light emitted by the LED.

In one arrangement, an electronic device includes a first voltage source, an integrated circuit (IC), a second voltage source different than the first voltage source, and a light emitting diode (LED). The IC includes a first pin, a second pin, and a current generator coupled to the first pin and the second pin. The first pin is electrically coupled to the first voltage source and is configured to receive a supply voltage from the first voltage source. The LED includes a first terminal and a second terminal, the first terminal being electrically coupled to the second voltage source and configured to receive a supply voltage from the second voltage source and the second terminal being electrically coupled to the current generator via the second pin of the integrated circuit. The current generator is operable to (i) conduct a first current through the LED, the first current sufficient to cause the LED to emit light and (ii) conduct a second current through the LED, the second current being insufficient to cause the LED to emit light.

In one arrangement, an electronic device includes a first voltage source, an integrated circuit (IC), a second voltage source different than the first voltage source, and a light emitting diode (LED). The IC includes a first pin, a second pin, and a current generator coupled to the first pin and the second pin. The first pin is electrically coupled to the first voltage source and is configured to receive a supply voltage from the first voltage source, the supply voltage being less than a voltage operable to activate a light emitting diode. The LED includes a first terminal and a second terminal, the first terminal being electrically coupled to the second voltage source and configured to receive a supply voltage from the second voltage source and the second terminal being electrically coupled to the second pin of the integrated circuit, current generator configured to conduct a current through the LED.

One embodiment of the invention relates to a method for electrically driving a light emitting diode (LED). The method includes coupling a first terminal of the LED to a first voltage source and coupling a second terminal of the LED to an integrated circuit having a current generator. The method further includes electrically coupling the integrated circuit to a second voltage source operable to provide a supply voltage to the integrated circuit, the second voltage source being different than the first voltage source and activating the integrated circuit to cause the current generator to (i) conduct a first current through the LED, the first current sufficient to cause the LED to emit light and (ii) conduct a second current through the LED, the second current being insufficient to cause the LED to emit light.

BRIEF DESCRIPTION OF THE DRAWINGS

The foregoing and other objects, features and advantages of the invention will be apparent from the following description of particular embodiments of the invention, as illustrated in the accompanying drawings in which like reference characters refer to the same parts throughout the different views. The drawings are not necessarily to scale, emphasis instead being placed upon illustrating the principles of the invention.

DETAILED DESCRIPTION

Embodiments of the invention are directed to a method and apparatus for driving a light emitting diode. An LED drive circuit includes a current source configured to electrically drive an LED where the current source maintains a current when the voltage across it changes. The current source draws a substantially constant current through the LED, compared to the use of a current liming resistor in series with the LED. In one configuration, the current source forms part of an integrated circuit that requires a relatively small amount of voltage for operation. As such, separate voltage sources can be electrically coupled to the LED and integrated circuit respectively. For example, a first voltage source provides a source voltage to the LED that is sufficient to allow operation the LED and a second voltage source provides a source voltage to the integrated circuit that is sufficient to allow operation of the integrated circuit but that is less than a voltage operable to activate the LED. As a result, a low voltage source can be used as a supply for all of the circuitry associated with the integrated circuit, including the current source, without sacrificing the supply voltage used to drive the LED. As such, the supply voltage to the LED can be large enough to minimize effects of current tolerance on the brightness of the light emitted by the LED.

Figure 2:
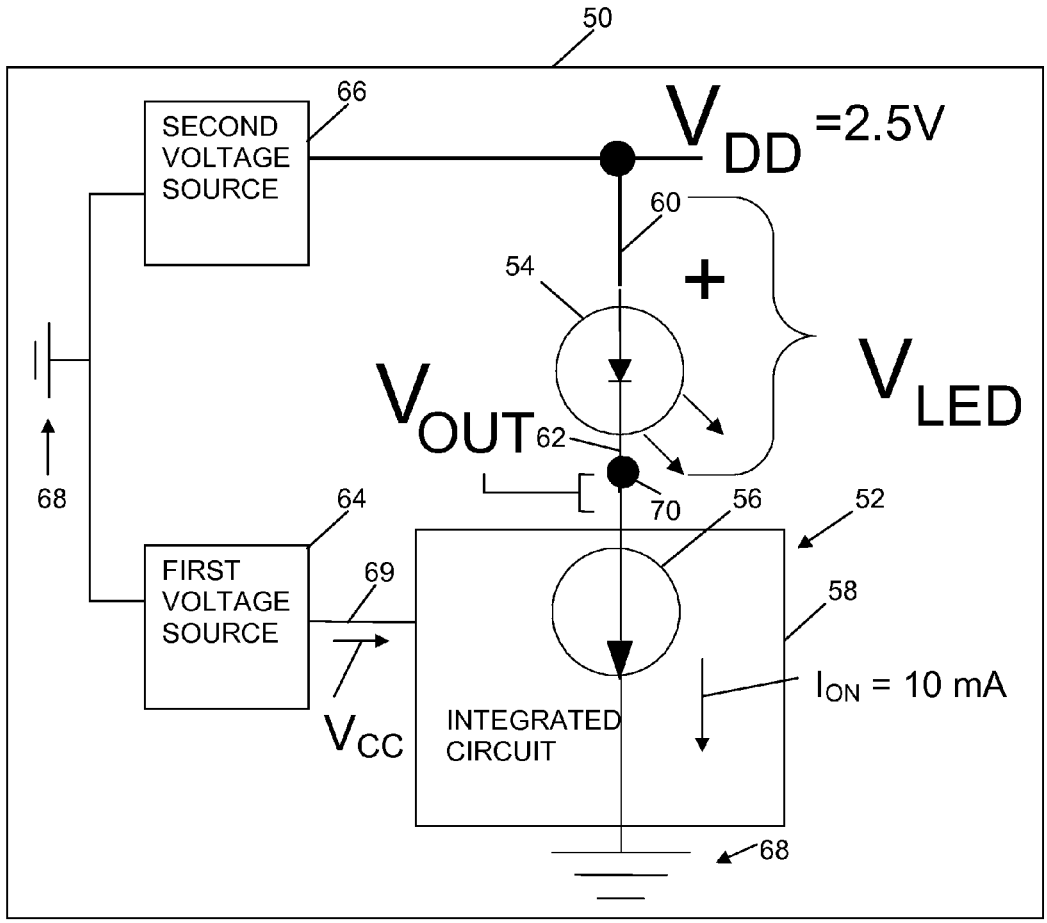
FIG. 2 illustrates a schematic representation of an electronic device having an LED driver circuit that includes an integrated circuit and a current generator, according to one embodiment of the invention.

FIG. 2 illustrates an embodiment of an electronic device 50, such as a data communications device or PoE device, having an LED drive circuit 52 with one or more LEDs 54 electrically coupled thereto. As illustrated, the LED drive circuit 52 includes an integrated circuit 58 having a current generator 56 configured to electrically drive the LED 54.

The LED 54 includes a first lead 60 configured to receive a supply voltage $V_{DD}$ from a voltage source 66 and a second lead 62 configured to couple to the current generator 56. The LED 54 is operable to provide status information regarding the operation of the electronic device 50. For example, in the case where the device 50 is a data communications device, an illuminated LED 54 can indicate that the device 50 is actively transmitting communications among user devices while a non-illuminated LED can indicate that the device 50 is not transmitting communications among user devices. While the LED 54 can be any type of light emitting diode, in one arrangement, the LED 54 is a right angle LED indicator such as model L934EW/LGD produced by Kingbright Corporation, Taipei, Taiwan.

The integrated circuit 58 includes a first pin or anode 69 and a second pin or node 70 where the first pin 69 is configured to receive a supply voltage $V_{CC}$ from a voltage source 64 and the second pin 70 is configured to electrically couple the current generator 56 to the LED 54. In one arrangement, the integrated circuit 58 is dedicated to generating a current to electrically drive the LED 54. For example, the integrated circuit 58 can be a TOSHIBA TB627 Series Constant Current Driver produced by Toshiba, New York, N.Y. In another arrangement, the integrated circuit 58 is configured as a PHY or a PoE integrated circuit, such as a such as a LTC4259A-1 Quad IEEE 802.3af Power over Ethernet Controller (Linear Technology, Milpitas, Calif.) or a LTC4257-1 IEEE 802.3af Power over Ethernet Interface Controller (Linear Technology, Milpitas, Calif.), that includes the current generator 56. In yet another arrangement, the integrated circuit 58 can be configured as a switch fabric ASIC or can be utilized in conjunction with the circuits of an integrated Ethernet connector, such as described in U.S. Pat. No. 6,817,890, the contents of which is incorporated by reference in its entirety.

Figure 4:
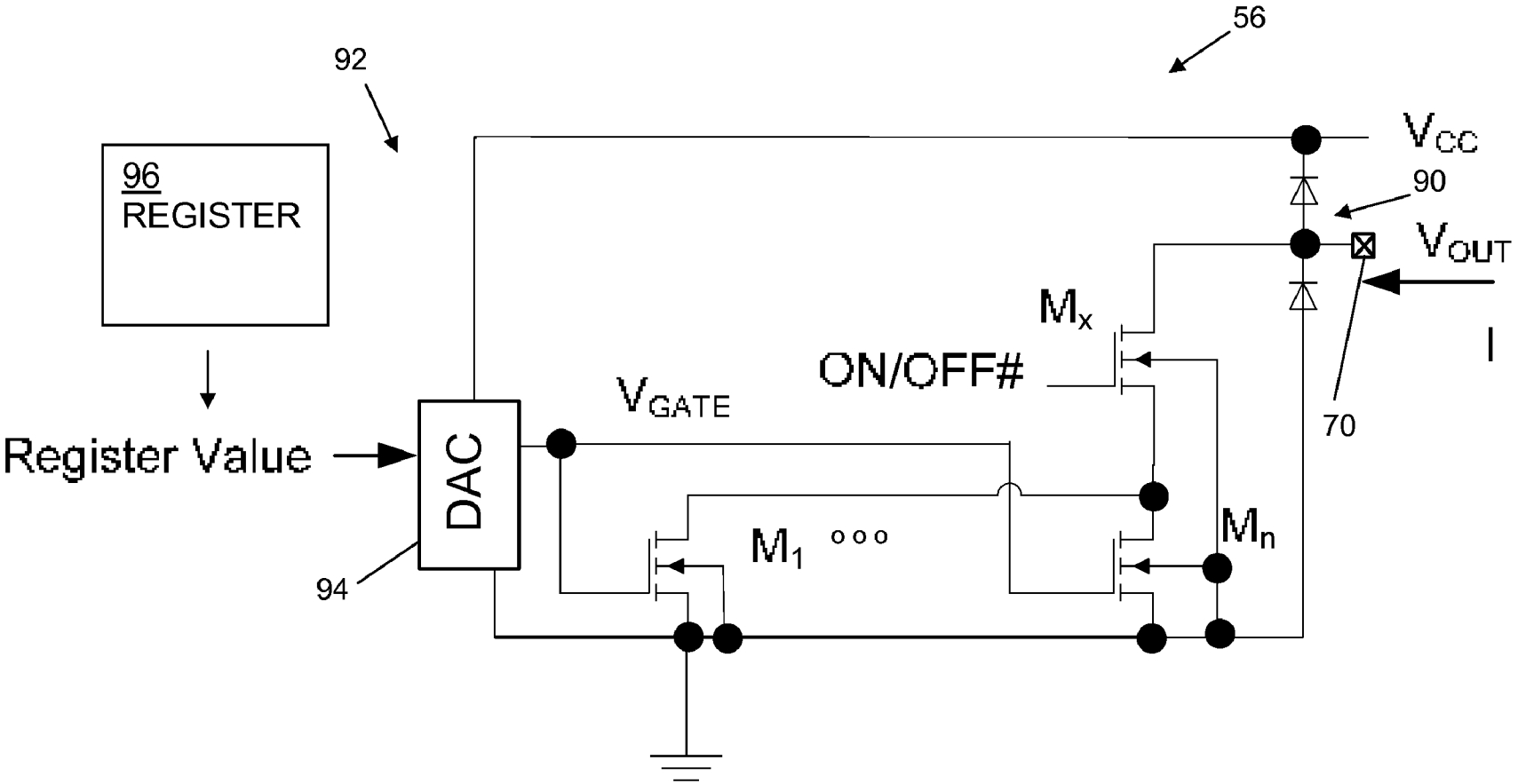
FIG. 4 illustrates the current generator of FIG. 2 as a MOSFET based device, according to one embodiment of the invention.

The integrated circuit 58 includes diodes 90, as indicated in FIG. 4. In one arrangement, the diodes 90 are an integrated series of diodes 90 coupled to a power supply $V_{CC}$ of the integrated circuit 58. The diodes 90 are configured as diode clamps forming a clamping circuit that clamps an output voltage $V_{OUT}$ at the pin 70 and limit or prevent an over voltage condition at the pin 70, such as caused by the voltage $V_{OUT}$ being pulled up to an LED supply voltage $V_{DD}$. The diode clamps 90 are typically "off", thereby allowing the clamping of transient voltages. However, continuous driving of the diode clamps 90 can lead to heating and injection of minority carriers into the integrated circuit 58.

The current generator 56 of the integrated circuit 58 is configured to conduct a current I through the LED 54 where the current I is sufficient to activate the LED 54 and cause the LED 54 to emit light. In the embodiment illustrated in FIG. 2, the current generator 56 is operable as a current sink to draw current through the LED 54. For example, as indicated above, the first lead 60 of the LED 54 can be configured as an anode that is attached to a voltage source 66 and the second lead 62 of the LED 54 can be configured as a cathode that is coupled to the current generator 56. In use, the current generator 56 draws current through the LED 54 from the anode 60 to the cathode 62 to activate the LED 54 and cause the LED 54 to emit light.

The electronic device 50 also includes a separate first voltage source 64 and second voltage source 66 each of which are electrically coupled to the integrated circuit 58 and LED 54 respectively. As illustrated, while configured as separate and distinct voltage sources, the first and second voltage sources 64, 66 share a common voltage reference 68, such as a ground reference. In this configuration, the first voltage source 64 is operable to provide a supply voltage $V_{CC}$ to the integrated circuit 58 while the second voltage source 66 is operable to provide a supply voltage $V_{DD}$ such as a voltage of about 5V to the LED 54. In this configuration, the integrated circuit 58 does not provide a supply voltage to the LED 54.

In use, the second voltage source 66 provides a supply voltage $V_{DD}$, such as a voltage of about 5V, to the LED 54 and the first voltage source 64 provides a supply voltage $V_{CC}$, such as a voltage of less than 5V, to the integrated circuit 58. The integrated circuit 58 causes the current generator 56 to conduct a current I, such as a current of about 10 mA, that is sufficient to cause the LED 54 to emit light. As the current generator 56 conducts the current I through the LED 54, the current I activates the LED 54 and causes the LED 54 to emit light.

Because the first and second voltage sources 64, 66 each provide a separate supply voltage $V_{CC}$, $V_{DD}$ to the integrated circuit 58 and LED 54, respectively, the supply voltage $V_{DD}$ can be large enough to minimize the effect of current tolerance on the level of light emitted (e.g., brightness) of the LEDs 54, thereby allowing multiple LEDs 54 associated with the computerized device 50 to generate substantially uniform (e.g., substantially visually indistinguishable) levels of brightness. Additionally, because the integrated circuit 58 receives a source voltage distinct from the source voltage used to drive the LED 54, the supply voltage $V_{CC}$ can be small enough to drive integrated circuits having a variety of voltage requirements. For example, while the first voltage source 64 provides a supply voltage $V_{CC}$, such as a voltage of less than 5V, the supply voltage $V_{CC}$ can be 3.3V, 2.5V, 1.8V or less depending upon the configuration and requirements of the integrated circuit 58.

As described with respect to FIG. 2, the current source 56 is configured as a current sink 56. In such a case, in one embodiment, in order to avoid or limit damage to the integrated circuit 58, the integrated circuit 58 can be designed such that $V_{OUT}$ at the pin 70 is not pulled up to the supply voltage $V_{DD}$. For example, assume the current generator 56 does not draw a current I thought the LED 54 and the second voltage source 66 provides $V_{DD}$ to the LED 54. Because the LED 54 has an associated amount of resistance, the voltage $V_{OUT}$ at the pin 70 can be pulled up to the LED supply voltage $V_{DD}$. For example, if $V_{DD}$ is 2.5V, the voltage $V_{OUT}$ at the pin 70 can approach 2.0V. If the voltage at the pin 70 is above a maximum voltage rating of the integrated circuit 58, current can enter the clamping circuit (e.g., the integrated series of diodes 90 connected to the integrated circuit voltage supply 64 and the integrated circuit 58 can be damaged.

In order to accommodate $V_{DD}$ supply voltages that are above the maximum voltage rating of the integrated circuit 58 or the current source 56, the integrated circuit 58 can be configured such that the $V_{OUT}$ at pin 70 does not exceed the integrated circuit's supply rail 69 when the LED 54 is inactive. In one arrangement, the integrated circuit 58 is configured to generate two different currents through the LED 54. For example, as indicated above, the current generator 56 can generate a first current $I_{ON}$, such as a current of 10 mA, through the LED 54 that is sufficient to activate the LED 54 and cause the LED 54 to emit light. Additionally, when the integrated circuit 58 is not operable to drive the LED 54 (e.g., the LED is off), the integrated circuit 58 can draw a second current $I_{OFF}$ through the LED 54 that is insufficient to cause the LED 54 to emit light. This second current, however, is large enough to lower the voltage $V_{OUT}$ at the pin 70 to a level that limits or prevents clamping circuits 90 associated with the integrated circuit 58 from operating. Without $I_{OFF}$, $V_{OUT}$ of the integrated circuit 58 could be pulled up to the supply voltage $V_{DD}$. The current $I_{OFF}$ helps pull the voltage $V_{OUT}$ below $V_{DD}$ at the node 70. This ensures that current does not enter the clamping circuit and potentially damage the integrated circuit 58.

Figure 3A:
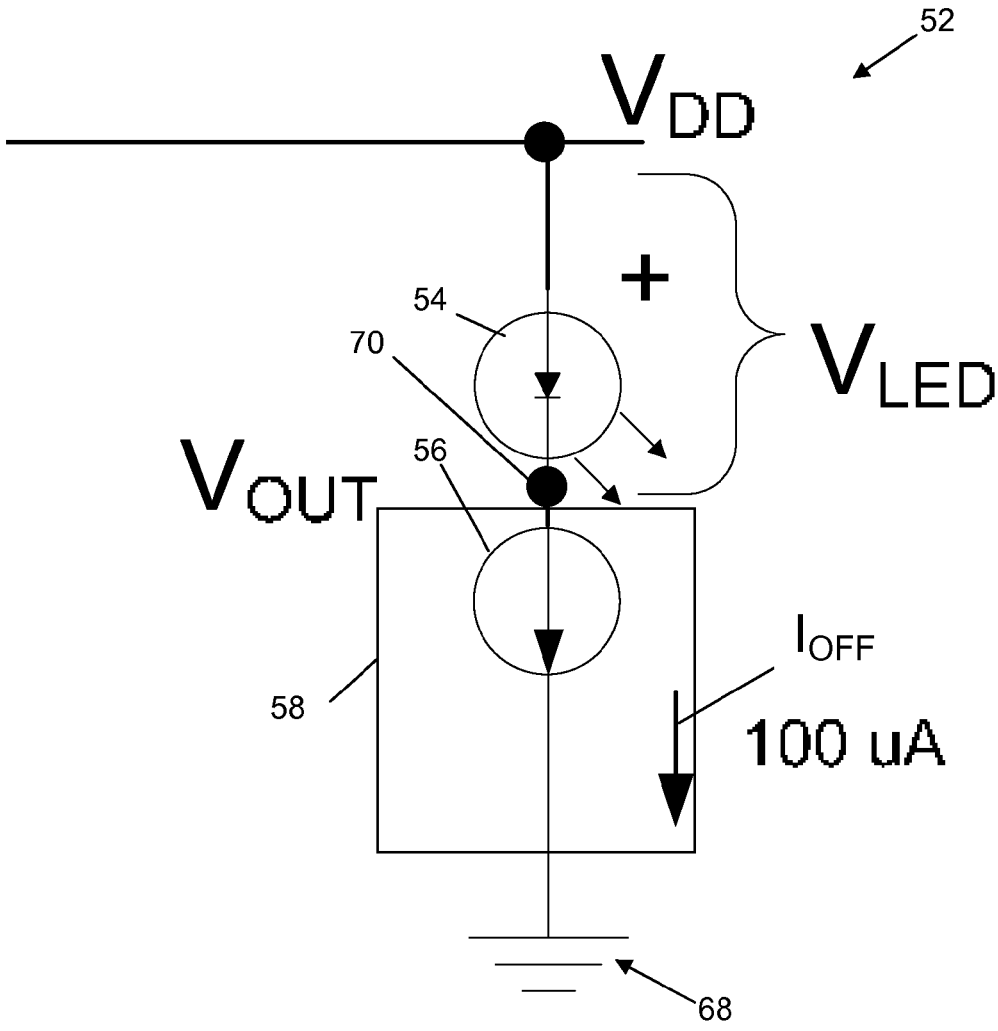
FIG. 3A illustrates the current generator of FIG. 2 configured to conduct a current through an LED where the current is insufficient to cause the LED to emit light, according to one embodiment of the invention.

In one arrangement as illustrated in FIG. 3A, the current generator 56 forms a current sink path between the LED 54 and the ground reference 68. When the integrated circuit 58 is not operable to drive the LED 54, the current source 56 is configured to conduct a current $I_{OFF}$ through the LED 54 where $I_{OFF}$ is insufficient to cause the LED 54 to emit light. For example, as illustrated in FIG. 3A, the current source 56 reduces the sink current from $I_{ON}$, such as a current of 10 mA, to a relatively small current $I_{OFF}$ such as a current of about 100 uA. The current $I_{OFF}$ is small enough so as to not cause illumination of the LED 54 and is large enough to lower the voltage $V_{OUT}$ at the pin 70 to a level that limits or prevents the clamping diodes 90 associated with the integrated circuit 58 from operating.

In use, when the LED 54 is on (e.g., generates light), $V_{OUT}$ at the node 70 is equal to $V_{DD}-V_{LED}$. This voltage $V_{OUT}$ will be less than a clamp voltage $V_{CLAMP}$ associated with the clamping circuit and normally be large enough to ensure that the tolerances associated with $V_{LED}$ and $V_{DD}$ allows a particular current to be drawn through the LED 54 to activate the LED 54. When the LED 54 is off (e.g., does not generate light), $V_{OUT}$ will be relatively large but not large enough to cause operation of the clamping diodes 90, thereby setting an upper bound on the voltage $V_{OUT}$ at the node 70. For example:

$$V_{OUT}=V_{DD}-V_{LED_OFF}$$

$$V_{CLAMP}>V_{CC}+xV_{D}$$

where "x" is the number of clamp diodes 90 in series with the $V_{CC}$ power supply, each diode having a voltage drop $V_D$, and $V_{LED_OFF}$ is the voltage across the LED 54 when off. As a result, $V_{OUT}$ at pin 70 remains at a level that is approximately equal to $V_{DD}-V_{LED}$ and at a level that is less than a sum of the clamp voltage $V_{CLAMP}$ of the diodes 90 and the voltage drop across one or more of the clamp diodes 90 (e.g., $V_{DD}-V_{LED_OFF}<V_{CC}+xVD$). Therefore, the voltage $V_{OUT}$ at the pin 70 is sufficient to minimize or prevent the voltage at the pin 70 from being pulled up to the LED supply voltage $V_{DD}$, thereby limiting or preventing damage to the integrated circuit 58.

Figure 3B:
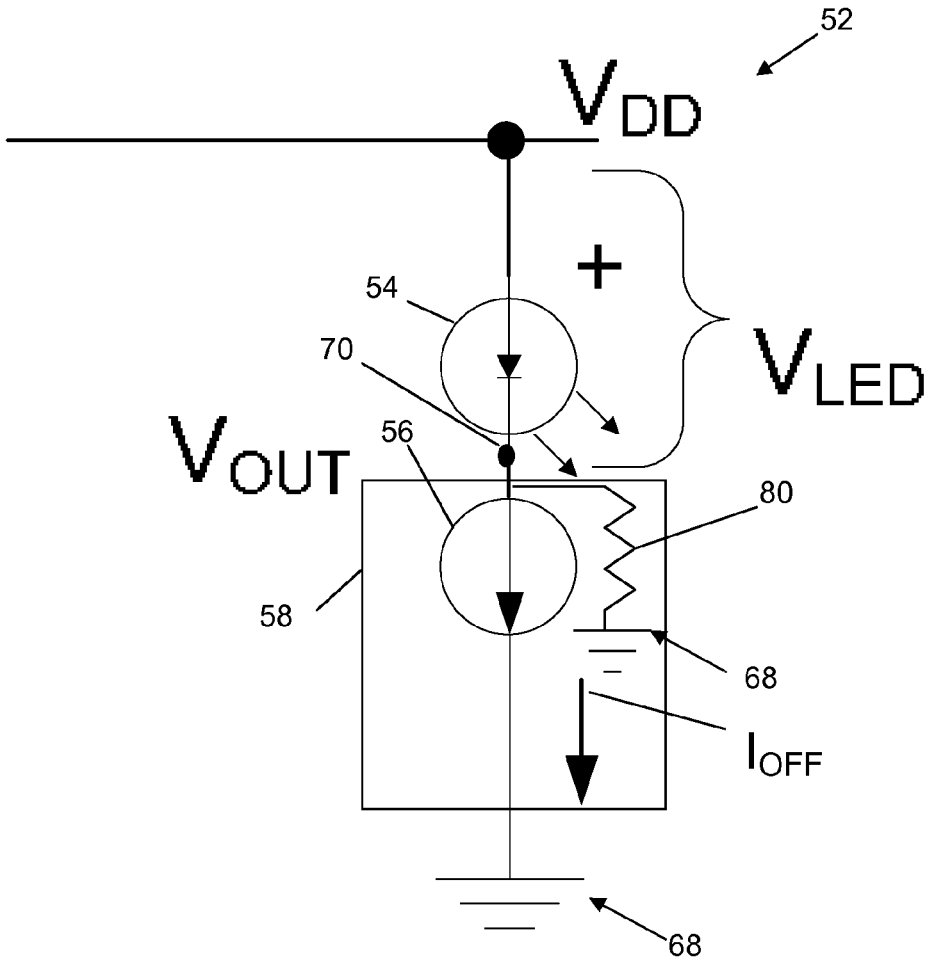
FIG. 3B illustrates the current generator of FIG. 2 having a pull down resistor configured to conduct a current through the LED where the current is insufficient to cause the LED to emit light, according to one embodiment of the invention.

In another arrangement as illustrated in FIG. 3B, to prevent the voltage at the pin 70 from being pulled up to the LED 54 supply voltage $V_{DD}$, the integrated circuit 58 includes a pull down resistor 80 coupled to the pin 70. While the pull down resistor 80 can have a number of resistance values, in one embodiment, the resistor 80 has a value of at least 10 kohms. In use, when the current source 56 does not draw a current through the LED 54, the pull down resistor 80 forms a current sink path through pin 70 between the LED 54 and the ground reference 68. In use, a leakage current $I_{OUT}$, enters the integrated circuit 58 at node 70. The current $I_{OUT}$, such as a current of about 100 uA, is insufficient to cause the LED 54 to emit light. The current $I_{OUT}$, enters the current sink path between the LED 54 and the ground reference 68 rather than entering the clamp circuit for the node 70 as formed by the diodes 90. As a result, $V_{OUT}$ at pin 70 remains at a level that is approximately equal to $V_{DD}-V_{LED}$ but that is less than the clamp voltage $V_{CLAMP}$ of the diodes 90 (e.g., $V_{DD}-V_{LED_OFF}<V_{CC}+xVD$). The voltage $V_{OUT}$ at the pin 70 is sufficient to minimize or prevent the voltage at the pin 70 from being pulled up to the LED supply voltage $V_{DD}$, thereby limiting or preventing damage to the integrated circuit 58.

As indicated above, the current generator 56 is operable to generate a current to activate the LED 54. While the current generator 56 can have a variety of configurations, in one arrangement, the current generator 56 is a MOSFET based device operable to generate the current I.

FIG. 4 illustrates an arrangement of the current generator 56 having MOSFETs $M_1$ through $M_n$ and one or more diodes 90. The MOSFETs $M_1$ through $M_n$ are configured to provide a current conduction path for the current $I_{ON}$ and form the equivalent of a single transistor. In the case where all MOSFETs $M_1$ through $M_n$ are substantially equivalent, each MOSFET carries approximately 1/n of the total amount of current $I_{ON}$. In use, when the current generator 56 is activated, such as by $V_{CC}$, the MOSFET $M_x$ is pulled to $V_{CC}$ to provide a current conduction path for the current $I_{ON}$. When $M_x$ is pulled to ground, the MOSFET $M_x$ is off and the current $I_{ON}$ through the current generator 56 is substantially equal to zero mA.

As indicated above, the brightness of an LED 54 (e.g., as visually detected by a user) is proportional to the amount of current I that flows through the LED 54. In one arrangement, the integrated circuit 58 is configured to adjust the amount current I that flows through the LED 54 thereby adjusting the amount of light emitted by the LED. For example, the integrated circuit 58 includes a current adjustment mechanism 92 coupled to the current generator 56 that adjusts the amount current I conducted by the current generator 56 through the LED 54.

In the embodiment illustrated in FIG. 4, the current adjustment mechanism 92 includes a digital to analog converter 94 electrically coupled to the current generator 56 and a register 96 electrically coupled to the digital to analog converter 94. The digital to analog converter 94 includes resistor array, each resistor having a switch electrically coupled thereto, where the resistor array is are operable to provide a variable reference voltage $V_{REF}$ for the current source 56. The register 96 is configured to provide a series of bits to the digital to analog converter 94 to actuate the resistor switches to adjust the reference voltage $V_{REF}$ for the current source 56. As such, the digital to analog converter 94 and register 96 operate together to adjust the current conducted by the current generator 56 through the LED 54 to adjust the brightness of the LED 54.

Figure 5:
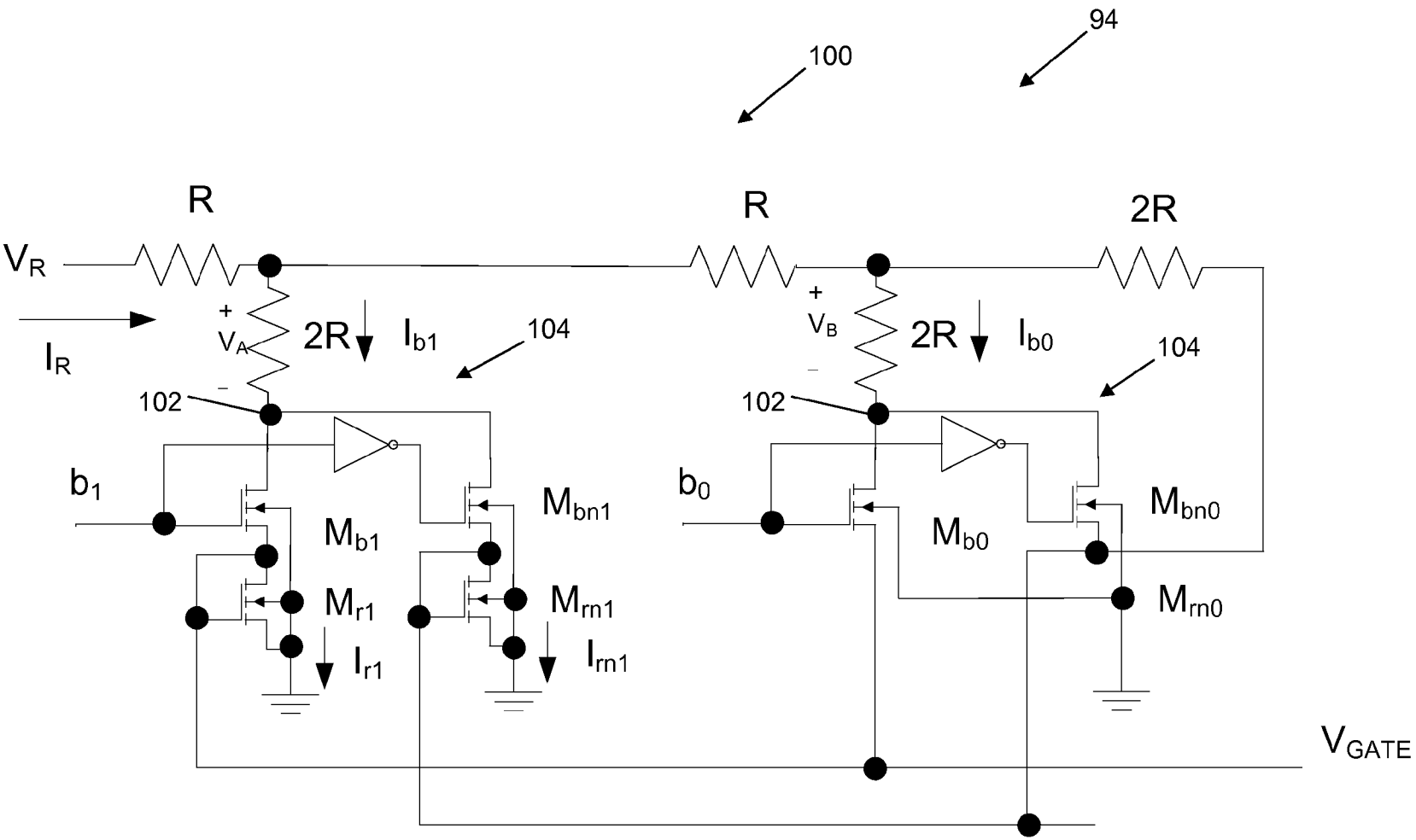
FIG. 5 illustrates an arrangement of a current adjustment mechanism of the integrated circuit of FIG. 2, according to one embodiment of the invention.

FIG. 5 illustrates a schematic representation of an arrangement of the digital to analog converter 94. While the digital to analog converter 94 is shown as having a two bit configuration, one of ordinary skill in the art will understand that the digital to analog converter 94 can be configured with additional bit sections.

As illustrated, an R-2R resistor ladder 100 is used to scale the current I conducted by the current generator 56. All 2R resistors are terminated to a drain connection 102 of a current mirror 104. The current mirror 104 is formed by MOSFET transistors such that a current in $M_{r1}$ is mirrored on transistors $M_1$ through $M_n$ in the current source 56, as illustrated in FIG. 4, to create the current I. In use, $$I_R \approx \frac{V_R - V_T}{2R}$$

where $V_R$ is a substantially stable reference voltage and $V_T$ is the voltage drop across the mirrored transistors $M_1$ through $M_n$. In one arrangement, the reference voltage is the voltage $V_{CC}$. Furthermore, the voltage $V_A$ is $$\frac{V_R - V_T}{2}.$$

The voltage $V_B$ is half of the value of $V_A$. When a bit $b_x$ is high (e.g., tied to $V_R$), transistor $M_{bx}$ is on and transistor $M_{bnx}$ is off. When $b_x$ is low (e.g., tied to ground), transistor $M_{bx}$ is off and transistor $M_{bnx}$ is on. The current $I_{bx}$ is approximately the same whether $b_x$ is high or low:

$$I_{b1} \approx \frac{V_R - V_T}{4R} \approx \frac{I_R}{2} \text{ and } I_{b0} \approx \frac{V_R - V_T}{8R} \approx \frac{I_R}{4}$$

For each bit section added, the current is halved:

$$I_{r1} \approx \frac{I_R}{2} b_1 + \frac{I_R}{4} b_0$$

The value of $b_x$, as provided by and derived from the register 96, is either one or zero. In this configuration, the current I can be scaled by the geometry of the transistors used. Additionally, a change in the value $b_x$, as provided by the register 96, can also proportionally change the value of the current I to adjust the amount of light emitted by the LED 54. In one arrangement, a binary coding mechanism can be used by the register 96 to cause a proportional change in the current. For example, as provided above, bits b1 and b0 represent the binary values (e.g. with b1 being the most significant bit). In response to a change in the binary values, the current undergoes a change (e.g., an increase or decrease) proportional to the change in the binary value. In one arrangement, the integrated circuit 58 can include an additional number of bits and analog sections to provide an increased range of control.

While this invention has been particularly shown and described with references to preferred embodiments thereof, it will be understood by those skilled in the art that various changes in form and details may be made therein without departing from the spirit and scope of the invention as defined by the appended claims.

Figure 6:
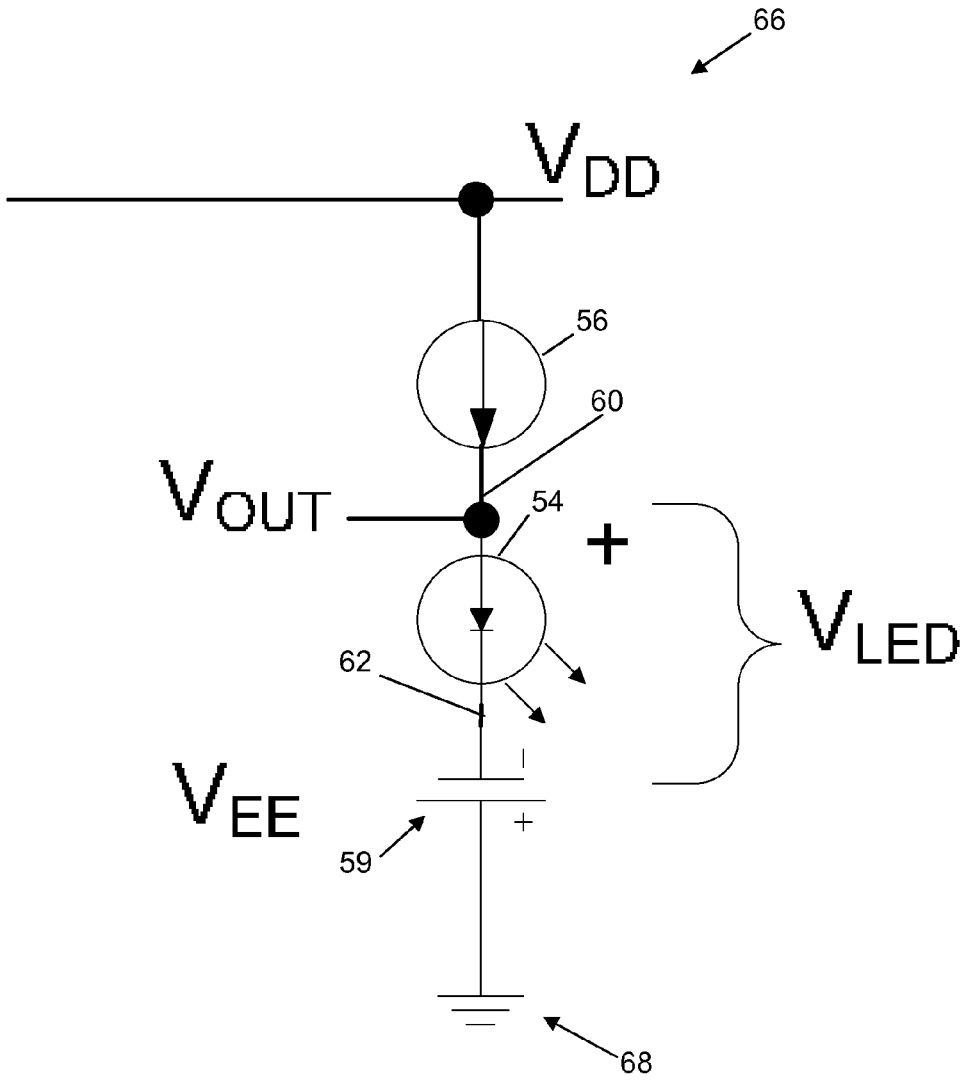
FIG. 6 illustrates the current generator of FIG. 2 configured as a current source, according to one embodiment of the invention.

For example, as shown in FIG. 2 and described above, the current generator 56 functions as a current sink to draw current through the LED 54. Such illustration and description is by way of example only. FIG. 6 illustrates another arrangement of the current generator 56 where the current generator 56 is configured as a current source. For example, the current generator 56 is disposed between the voltage source 66 and the anode 60 of the LED 54 and the cathode 62 of the LED 54 electrically coupled to a power supply $V_{EE}$ that is used as the power source to operate the LED 54. In use, the current generator 56 drives current into the LED 54 toward the cathode 62 to cause the LED 54 to emit light.

Figure 1:
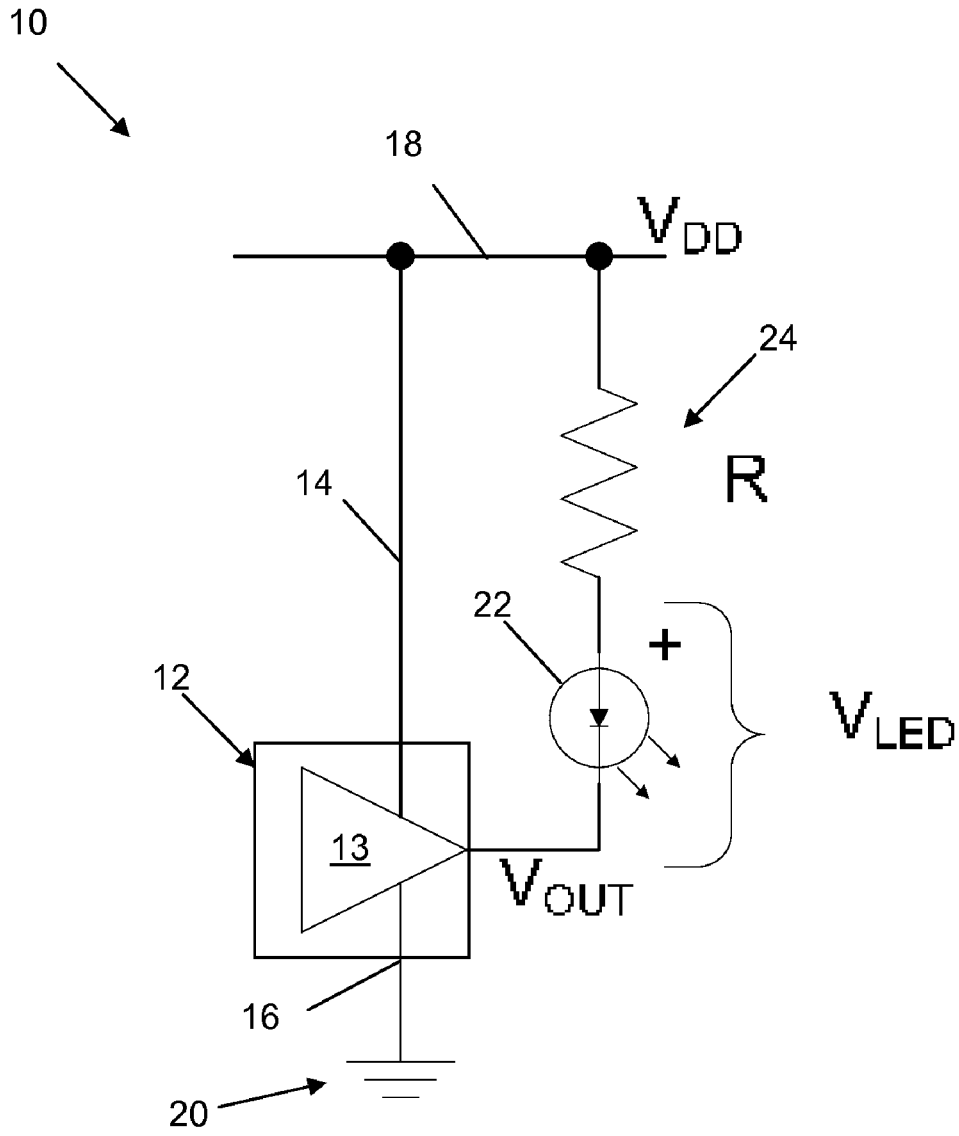
FIG. 1 (PRIOR ART)
FIG. 1 illustrates a schematic of a prior art LED driver circuit.

As described with respect to the embodiment above, the current source 56 forms part of an integrated circuit 58 that requires a relatively small amount of voltage for operation. As such, separate voltage sources 66, 64 can be electrically coupled to the LED and integrated circuit respectively. For example, a voltage source 66 provides a source voltage to the LED 54 that is sufficient to allow operation the LED 54 and a voltage source 64 provides a source voltage to the integrated circuit 58 that is sufficient to allow operation of the integrated circuit 58 but that is less than a voltage operable to activate the LED 54. Such description is by way of example only. In one arrangement, a current source can be used in conjunction with a device having a current liming resistor in series with the LED, such as illustrated in FIG. 1. In such an arrangement, the relatively larger voltage used for $V_{DD}$ would improve the current tolerance in the device. Additionally, when the integrated circuit 58 is not operable to drive the LED 54, the current source 56 or a pull-down resistor 80 can be used to conduct a current $I_{OFF}$ through the LED 54 in order to maintain $V_{OUT}$ at node 70 below a level that could potentially damage the integrated circuit 58.

What is claimed is:

1. An integrated circuit (IC), comprising:

a first pin configured to electrically couple to a first voltage source, the first voltage source configured to provide a supply voltage to the IC;

a second pin configured to couple to a light emitting diode (LED), the LED configured to electrically couple to a second voltage source configured to provide a supply voltage to the LED, the second voltage source being different than the first voltage source;

a current generator coupled to the second pin and configured to (i) conduct a first current through the LED, the first current sufficient to cause the LED to emit light and (ii) conduct a second current through the LED, the second current being insufficient to cause the LED to emit light; and a pull down resistor coupled to the second pin, the current generator configured to (i) conduct the first current having the first current value through the LED, the first current sufficient to cause the LED to emit light and (ii) conduct the second current through the LED, the second current being equal to zero amperes;

the pull down resistor configured to conduct a third current through the LED, the third current being insufficient to cause the LED to emit light.

2. The integrated circuit of claim 1, wherein the integrated circuit comprises a current adjustment mechanism coupled to the current generator and configured to adjust an amount of current conducted by the current generator through the LED.

3. The integrated circuit of claim 2, wherein the current adjustment mechanism comprises an array of resistors, each resistor having a switch electrically coupled thereto.

4. The integrated circuit of claim 3, wherein the integrated circuit is configured with a register operable to cause actuation at least one switch of a resistor of the array of resistors to adjust an amount of current conducted by the current generator through the LED.

5. The integrated circuit of claim 1, wherein the current generator is configured to couple to a cathode of the LED and is operable as a current sink to draw current through the LED.

6. The integrated circuit of claim 1, wherein the current generator is configured to couple to an anode of the LED and is operable as a current source to drive current into the LED.

7. The integrated circuit of claim 1, wherein the second current is configured to maintain a voltage at the second pin at a level that is approximately equal to a difference between the supply voltage from the second voltage source and a voltage drop across the LED.

8. The integrated circuit of claim 7, wherein the second current is further configured to maintain the voltage at the second pin at a level that is less than a sum of a supply voltage from the first voltage source and a voltage drop across at least one diode of the integrated circuit.

9. An electronic device comprising:

a first voltage source;

an integrated circuit (IC) having a first pin, a second pin, and a current generator coupled to the first pin and the second pin, the first pin electrically coupled to the first voltage source and configured to receive a supply voltage from the first voltage source;

a second voltage source, the second voltage source being different than the first voltage source; and a light emitting diode (LED) having a first terminal and a second terminal, the first terminal electrically coupled to the second voltage source and configured to receive a supply voltage from the second voltage source and the second terminal electrically coupled to the current generator via the second pin of the integrated circuit, the current generator being operable to (i) conduct a first current through the LED, the first current sufficient to cause the LED to emit light and (ii) conduct a second current through the LED, the second current being insufficient to cause the LED to emit light;

wherein the integrated circuit further comprises a pull down resistor coupled to the second pin, the current generator configured to (i) conduct the first current having the first current value through the LED, the first current sufficient to cause the LED to emit light and (ii) conduct the second current through the LED, the second current being equal to zero amperes;

the pull down resistor is configured to conduct a third current through the LED, the third current being insufficient to cause the LED to emit light.

10. The electronic device of claim 9, wherein the integrated circuit comprises a current adjustment mechanism coupled to the current generator and configured to adjust an amount of current conducted by the current generator through the LED.

11. The electronic device of claim 10, wherein the current adjustment mechanism comprises an array of resistors, each resistor having a switch electrically coupled thereto.

12. The electronic device of claim 11, wherein the integrated circuit is configured with a register operable to actuate at least one switch of a resistor of the array of resistors to adjust an amount of current conducted by the current generator through the LED.

13. The electronic device of claim 9, wherein the second terminal of the LED comprises a cathode and wherein the current generator is electrically coupled to the cathode of the LED and is operable as a current sink to draw current through the LED.

14. The electronic device of claim 9, wherein the second terminal of the LED comprises an anode and wherein the current generator is electrically coupled to an anode of the LED and is operable as a current source to drive current into the LED.

15. An electronic device comprising:

a first voltage source;

an integrated circuit (IC) having a first pin, a second pin, and a current generator coupled to the first pin and the second pin, the first pin electrically coupled to the first voltage source and configured to receive a supply voltage from the first voltage source, the supply voltage being less than a voltage operable to activate a light emitting diode;

a second voltage source, the second voltage source being different than the first voltage source;

a light emitting diode (LED) having a first terminal and a second terminal, the first terminal electrically coupled to the second voltage source and configured to receive a supply voltage from the second voltage source and the second terminal electrically coupled to the second pin of the integrated circuit, current generator configured to conduct a current through the LED; and further comprising a pull down resistor coupled to the second pin, the current generator configured to (i) conduct the first current having the first current value through the LED, the first current sufficient to cause the LED to emit light and (ii) conduct the second current through the LED, the second current being equal to zero amperes;

the pull down resistor configured to conduct a third current through the LED, the third current being insufficient to cause the LED to emit light.

16. The electronic device of claim 15, wherein the source voltage provided by the first voltage source is about 5V and the source voltage provided by the second voltage source less than 5V.

17. The electronic device of claim 16, wherein the source voltage provided by the second voltage source less that about 3.3V.

18. The electronic device of claim 15, wherein the current generator is configured to (i) conduct a first current through the LED, the first current sufficient to cause the LED to emit light and (ii) conduct a second current through the LED, the second current being insufficient to cause the LED to emit light.

19. The electronic device of claim 15, wherein the integrated circuit comprises a current adjustment mechanism coupled to the current generator and configured to adjust an amount of current conducted by the current generator through the LED.

20. A method for electrically driving a light emitting diode (LED), comprising:

coupling a first terminal of the LED to a first voltage source;

coupling a second terminal of the LED to an integrated circuit having a current generator;

electrically coupling the integrated circuit to a second voltage source operable to provide a supply voltage to the integrated circuit, the second voltage source being different than the first voltage source; and activating the integrated circuit to cause the current generator to (i) conduct a first current through the LED, the first current sufficient to cause the LED to emit light and (ii) conduct a second current through the LED, the second current being insufficient to cause the LED to emit light and the second current being equal to zero amperes; and conduct by a pull down resistor coupled to the driver circuit a third current through the LED, the third current being insufficient to cause the LED to emit light.

21. The method of claim 20, further comprising adjusting an amount of current conducted by the current generator through the LED.

22. An integrated circuit (IC), comprising:

a first pin configured to electrically couple to a first voltage source, the first voltage source configured to provide a supply voltage to the IC;

a second pin configured to couple to a light emitting diode (LED), the LED configured to electrically couple to a second voltage source configured to provide a supply voltage to the LED, the second voltage source being different than the first voltage source; and a current generator coupled to the second pin and configured to (i) conduct a first current through the LED, the first current sufficient to cause the LED to emit light and (ii) conduct a second current through the LED, the second current being insufficient to cause the LED to emit light;

wherein the integrated circuit comprises a current adjustment mechanism coupled to the current generator and configured to adjust an amount of current conducted by the current generator through the LED;

wherein the current adjustment mechanism comprises an array of resistors, each resistor having a switch electrically coupled thereto;

wherein the integrated circuit is configured with a register operable to cause actuation at least one switch of a resistor of the array of resistors to adjust an amount of current conducted by the current generator through the LED.

23. An integrated circuit (IC), comprising:

a first pin configured to electrically couple to a first voltage source, the first voltage source configured to provide a supply voltage to the IC;

a second pin configured to couple to a light emitting diode (LED), the LED configured to electrically couple to a second voltage source configured to provide a supply voltage to the LED, the second voltage source being different than the first voltage source; and a current generator coupled to the second pin and configured to (i) conduct a first current through the LED, the first current sufficient to cause the LED to emit light and (ii) conduct a second current through the LED, the second current being insufficient to cause the LED to emit light;

wherein the second current is configured to maintain a voltage at the second pin at a level that is approximately equal to a difference between the supply voltage from the second voltage source and a voltage drop across the LED;

wherein the second current is further configured to maintain the voltage at the second pin at a level that is less than a sum of a supply voltage from the first voltage source and a voltage drop across at least one diode of the integrated circuit.

* * * * *